US010549151B2

(12) United States Patent
McGhee

(10) Patent No.: US 10,549,151 B2
(45) Date of Patent: Feb. 4, 2020

(54) APPARATUS FOR STRENGTHENING FACIAL BONES AND MUSCLE IN COSMETIC, STROKE, AND IDIOPATHIC FACIAL PARALYSIS PATIENTS AND METHODS OF USE

(71) Applicant: Prentice Capri McGhee, Atlanta, GA (US)

(72) Inventor: Prentice Capri McGhee, Atlanta, GA (US)

( * ) Notice: Subject to any disclaimer, the term of this patent is extended or adjusted under 35 U.S.C. 154(b) by 0 days.

(21) Appl. No.: 16/436,520

(22) Filed: Jun. 10, 2019

(65) Prior Publication Data

US 2019/0374812 A1 Dec. 12, 2019

Related U.S. Application Data

(60) Provisional application No. 62/682,556, filed on Jun. 8, 2018.

(51) Int. Cl.
*A63B 23/03* (2006.01)
*A63B 21/02* (2006.01)

(52) U.S. Cl.
CPC ..... *A63B 23/03* (2013.01); *A63B 21/023* (2013.01); *A63B 21/028* (2013.01)

(58) Field of Classification Search
CPC ..... A63B 23/025; A63B 23/03; A63B 23/032; A63B 2071/086; A63B 2071/088; A63B 21/05; A63B 71/085; A61H 2205/026; A61H 1/02; A61C 5/90; G03G 2215/00827
USPC ..... 601/38; 482/10, 11
See application file for complete search history.

(56) References Cited

U.S. PATENT DOCUMENTS

| | | | | |
|---|---|---|---|---|
| 4,280,696 A * | 7/1981 | Ramon | A63B 23/032 482/11 |
| 5,919,116 A * | 7/1999 | Edell | A63B 23/032 482/11 |
| 6,406,405 B1 * | 6/2002 | Chu | A63B 23/032 482/11 |
| 2004/0166993 A1 * | 8/2004 | Tiberio | A63B 23/032 482/11 |
| 2006/0122036 A1 * | 6/2006 | Ferrara | A63B 21/02 482/11 |

(Continued)

*Primary Examiner* — Gary D Urbiel Goldner
*Assistant Examiner* — Zachary T Moore
(74) *Attorney, Agent, or Firm* — Richard Piercy; Grell & Watson Patent Attorneys LLC

(57) ABSTRACT

A facial exercise apparatus for facial muscle and bone resistance training and method of use. The facial exercise apparatus includes one or more flexor arms and a mouthpiece stabilizer, each connected to a flexor head connector. The flexor arm(s) extend upward, downward, left or right from the flexor head connector, have contours to place the patient's lips, and provide a resistance force outward from the flexor head connector. In use, a patient places and bites down upon the mouthpiece stabilizer, places a portion of their lips along a contoured portion of one or more of the flexor arms, and pushes their lips toward the center of the flexor head connector against the resistance of the flexor arm(s). When done at regular intervals and increasing resistances, the apparatus can strengthen a patient's facial muscles and bone and reduce the cosmetic appearance of wrinkles on their face.

19 Claims, 8 Drawing Sheets

(56) References Cited

U.S. PATENT DOCUMENTS

2015/0251051 A1* 9/2015 Mohammed ..... A63B 23/032
482/11

* cited by examiner

APPARATUS FOR STRENGTHENING FACIAL BONES AND MUSCLE IN COSMETIC, STROKE, AND IDIOPATHIC FACIAL PARALYSIS PATIENTS AND METHODS OF USE

CROSS-REFERENCE TO RELATED APPLICATIONS

To the full extent permitted by law, the present United States Non-provisional patent application hereby claims priority to and the full benefit of, U.S. Provisional Application No. 62/682,556, filed on Jun. 8, 2018, entitled "ISO Device," which is incorporated herein by reference in its entirety.

BACKGROUND OF THE DISCLOSURE

Technical Field of the Disclosure

The instant disclosure relates to exercise devices, namely an apparatus to be used to strengthen facial bones and muscles in patients who have suffered a stroke, Bell's palsy, idiopathic facial paralysis or for the cosmetic reduction of wrinkles through facial strengthening. More particularly, the instant disclosure relates to an adjustable device or apparatus that may be gripped by the exerciser's teeth and fitted around the exerciser's lips in order to exercise and thereby strengthen facial bones and muscles through routine exercises and increasing resistance against the exerciser's lips by adjusting the resistance of the apparatus.

Description of the Related Art

Patients who have suffered a stroke or who live with the condition of Bell's palsy, or as more appropriately termed idiopathic facial paralysis, often suffer from what they or others may perceive to be unsightly or asymmetrical facial disfigurement. These conditions affect tens of thousands of adults every year and may often continue to affect these individuals throughout their life. Both of these conditions may strike suddenly to individuals often in the prime of their life, leaving them with physical challenges and, if not dealt with, permanent facial disfigurement. Though a variety of preventions and rehabilitation procedures or techniques may be available, these conditions continue to affect untold numbers of individuals throughout their life. Additionally, individuals who advance in age may suffer unsightly wrinkles in various places throughout their face as they age. While the causes of any particular wrinkle may be avoidable, ultimately, as any individual ages they will begin to notice these facial wrinkles appear in their face and may wish to reduce or eliminate the appearance.

Idiopathic facial paralysis causes sudden weakness in a patient's facial muscles, most often causing the symptomatic half of the patient's face to appear to droop lower than the asymptomatic half. The patient's smile may appear to be one-sided, the patient may drool from that side of their mouth, and the patient's eye on that side may resist closing. Idiopathic facial paralysis can occur at any age and, as its name would indicate, the exact cause may be unknown. Most studies indicate it to be a result of swelling and inflammation of the nerve that controls the muscles on one side of a patient's face. Some cases appear to be due to or caused by a viral infection. For most patients, idiopathic facial paralysis is temporary and symptoms may begin to improve within a few weeks with full recovery within six months to one year. Some patients, however, continue to suffer these symptoms throughout their life or the symptoms recur after recovery. In exceedingly rare cases, idiopathic facial paralysis can affect the nerves on both sides of the patient's face.

Strokes are caused by interference with blood supply to the brain. Blood is supplied to the brain from four main arteries. These branch into many smaller arteries which supply blood to all brain regions. The area of the brain affected by an interference with blood supply during a stroke will determine the nature and extent of the damage of the stroke in the affected patient. In the most severe cases, supply loss to a main artery can affect large areas of the brain and cause severe symptoms, even death. If smaller, branch arteries are affected, it may result in a more minor stroke and thereby cause relatively minor symptoms. These interferences in blood supply are most commonly caused by either an ischemia, a blood clot, a hemorrhage, or bleeding from a blood vessel. One common, though relatively minor, symptom of stroke is facial weakness and/or paralysis. Though minor in comparison to other, sometimes fatal, consequences of stroke, these symptoms are also common and typically long-lasting in survivors of stroke. Partial facial paralysis, or facial/stroke palsy, in stroke patients is generally a result of damage to the facial nerve inside the brain. This is common in both ischemic and hemorrhagic stroke due to lack of oxygen to this nerve which may happen within minutes of the first sign of a stroke. Commonly, only the lower part of the face is affected and only on one side of the patient. Often, unlike idiopathic facial paralysis, the patient's brow and upper eyelid remain fully functional, although the lower eyelid may be pulled downward due to the weight of the patient's cheek, especially if the patient's cheek loses muscle tone and strength subsequent to the stroke. Some patients report a facial droop, similar to idiopathic facial paralysis. Though they may still be able to smile spontaneously or involuntarily, patients with facial droop often report difficulty in smiling voluntarily. The patient may drool from the symptomatic side of their mouth, have difficulty speaking clearly, and have difficulty eating or drinking.

Various methods have been used to treat the unsightly or deforming symptoms of these conditions. For idiopathic facial paralysis, specifically, corticosteroids, such as prednisone are known to reduce the swelling of the facial nerve in order for it to fit more comfortably within the bony corridor that surrounds it. Additionally, antiviral drugs may have some effect on the underlying cause, though whether they have any effect beyond mere placebo is still debated. Physical therapy for paralyzed muscles which may otherwise shrink and/or shorten due to neuropathy and atrophy has been investigated with methods including massage and exercise to prevent this from occurring or relieve this symptom. Surgery may be indicated in some patients, though decompression surgery used to relieve the pressure on the facial nerve by opening the bony passage has fallen out of favor. Therefore, surgery is sometimes only recommended to correct lasting facial nerve problems. Other remedies, including over-the-counter pain relievers, at-home exercises, and alternative medicine such as acupuncture and biofeedback training have been investigated for idiopathic facial paralysis patients with mixed successes. Similar treatments and techniques are often used to treat patients who experience some form of facial paralysis after suffering a stroke, though again, these treatments may lack in efficacy across a wide population and may have each their own risks and/or downsides.

Though wrinkles may be thought of as a natural part of human aging, various factors may contribute, accelerate, and even cause wrinkles to appear on a person's face. They generally appear as creases, folds, or ridges on the skin, and can appear temporarily after spending a significant time in contact with water. Sometimes divided into only two categories—surface/fine lines and deep furrows—a variety of wrinkles may develop on an aging person's face and they may grow in number as the person advances in age. Generally, it is thought that the first wrinkles appear on a person's face as a result of the person's common facial expressions. Other causes include, but are not limited to, sun damage, smoking, dehydration, medications, environmental factors, and genetic/heredity factors. As it is human nature to hold on to the looks of one's youth, wrinkles on the face are generally an unwelcome sign of aging. Therefore, billions are spent globally in preventing and reducing the appearance of wrinkles.

Perhaps due to the commonality among all aging adults, the variety of preventions and treatments for wrinkles undoubtably varies to a great extent more than the treatment for idiopathic, stroke, or other facial palsies. Many people go to great lengths to prevent other signs of aging through clean-living and exercise, only to suffer the same signs of aging in their face as one who does not go to the same lengths. These individuals may seek out and try a variety of treatments to diminish these signs of aging on their face. Too countless to name, they tend to fall into three main categories: topical treatments, ingestible treatments, and major or minor surgeries. Topical treatments usually come in the form of creams or gels that are applied to the patient's face at regular intervals. They may include moisturizers, botanicals, vitamins, or other chemicals. Topical treatments are typically reserved for treatment of surface/fine line wrinkles and rarely, if ever, offer or even claim to offer any benefit to patients suffering from deep furrow wrinkles. While many topical treatments may make great claims, few have even moderate, or more than temporary effects, let alone significant, considerable, or long-lasting successes. The same may be said of ingestible or pill-form treatments, though advances continue to be made in this area with some moderate successes. Finally, moderate treatments and surgeries like dermabrasion, laser treatments, and chemical peels and more drastic treatments like Botox and collagen injections or cosmetic surgery may have more dramatic and immediate results, but at greater expense and risk with diminishing results over time. Some have even reported that repeated treatments can result in drastic or even monstrous-like facial appearances developing that may be most commonly recognizable among some of the most prominent aging public figures. Due to the difficulty in reducing the appearance of wrinkles after they begin to appear, many choose to employ techniques or lifestyles to prevent them from occurring in the first place. Preventing sun-damage with sun-screen lotion and protective clothing, quitting smoking, avoiding alcohol, and getting a good night's sleep may all contribute to a regimen of preventing facial wrinkles.

There may, however, exist ways to treat the prolonged symptoms of idiopathic and stroke palsy as well as treat, minimize, eliminate, or prevent the occurrence of wrinkles due to age by exercising the muscles behind the skin of one's face. Furthermore, other effects of aging on the face, including muscle atrophy and bone deterioration may similarly be diminished with routine strength training of the muscles of the face. While exercises may exist as well as some instruments and techniques to assist with said exercises, none exist which may be a part of a strength training regimen which may be increased in resistance over time to truly strengthen these facial bones and muscles.

Despite common media depictions of bones as lifeless scaffolding merely holding a body together, bones are living, active tissues that undergo constant remodeling. In humans and many animals, bones may serve many functions. In addition to providing structural support, protecting vital organs, and facilitating motility, they provide an environment for blood marrow, where blood cells are created, and act as a storage medium for minerals. At birth, humans have approximately 270, mainly soft, bones which harden throughout development and sometimes fuse, especially in the skull. At adulthood, an anatomically intact human has 206 bones. Bones mostly comprise the protein collagen, which by itself provides only a soft framework. When combined with the mineral calcium phosphate, this collagen framework hardens, giving it strength. Human bones in healthy individuals feel solid when slight pressure is placed upon them from the outside of the body. However, internally bones have a structure similar to a honeycomb, making them rigid, but relatively light. During the constant rebuilding and remodeling process of bones in young and/or healthy individuals, the bone tissue is broken down and rebuilt to maintain its rigid structure. While some cells and processes in the human body assist building bone tissue and strengthening it, others are responsible for breaking them down and result in the release of the minerals contained therein. During development, this process may mostly lean toward the bone building cells and biological processes. During adulthood, this process may reach a balance where each occur in a relatively even amount. As individuals age, both healthy individuals and those with disorders affecting these biological processes begin leaning toward dissolving bone tissue more than assembling bone tissue. The hormone estrogen, though present in higher concentrations in pre-menopausal women, is an important bone building hormone for both men and women. While estrogen generally remains at healthy levels in male humans throughout their life, women may begin to suffer from osteoporosis, the loss of bone tissue, during menopause due to the decrease in this hormone. While it is certainly important for women to monitor this process and make health and dietary considerations to stave off this process, aging men may also find benefit in monitoring bone density and making similar health and dietary considerations. Health and dietary considerations that are important to both staving off osteoporosis and increasing bone density include a high or supplemented Vitamin D and calcium diet, sunlight exposure, and exercise. Other considerations may include smoking cessation, moderating alcohol consumption.

It is well known that a healthy diet and regular exercise contribute to a healthy and aesthetically pleasing physique. Furthermore, it is well known that resistance exercises and weight training contribute to the building and defining of muscle mass. As resistance or weight is increased during a routine workout regimen, muscle mass increases and becomes more defined. When muscles increase in mass, more often than not, they may become more capable of performing resistance exercises and weight training. As one performs these exercises routinely and within a program of increasing resistance, the muscles continue to naturally grow, becoming stronger and larger. Accordingly, the appearance of these growing and stronger muscles becomes visible on the outer appearance of the body, as is often an important side benefit or possibly primary benefit, depending on a person's reasons for strength training. Not unlike muscles, bones, as living tissue, benefit from strength and resistance training. An important component of bone-building exercise is performing strength training and weight-bearing exercises.

While there are a multitude of popular ways to exercise the body to build strength of both bone and muscles (e.g. arms, legs, back, etc.), there exist few, if any, popular exercises for building facial bones and muscle. Since the typical intact human face contains a total of 43 muscles and 14 bones, various exercises can contribute to the strengthening and building these bones and muscles. Muscles of particular interest for treating the above conditions may include, but are not limited to, the left and right levator libii superioris, levator angul oris, zygomatic minor, zygomaticus major, orbicularis oculi, risorius, depressor anguli oris (triangularis), depressor labii inferioris, and mentalis, as well as the orbicularis oris. Bones of particular interest for treating the above conditions may include, but are not limited to, zygomatic, maxilla, and mandible bones. Offering an exercise machine to strengthen these muscles and bones in a controlled manner may help grow and strengthen these muscles, offering the benefit of increased mass beneath the skin and increased strength, thereby mitigating some of the effects of aging on patients suffering from wrinkles and rehabilitating patients suffering from stroke or Idiopathic facial paralysis.

Therefore, it is readily apparent that there is a recognized unmet need for a facial bone and muscle strengthening apparatus or device which can apply a precise resistance to specific muscles in a patient's face and thereby allow a treating physician to increase said resistance in order to increase the patient's muscle volume, muscle strength, bone volume, and bone density, thereby decreasing the symptoms of Bell's and stroke palsy and minimize and even eliminate wrinkles in the patient's face by growing and strengthening the sub-cutaneous tissue of a patient suffering from one or more of these conditions. The instant disclosure is designed to address this need through an apparatus or device and a corresponding method of using said apparatus or device, which includes the apparatus disclosed herein while addressing at least some of the aspects of the problems discussed above.

SUMMARY

Briefly described, in a possibly preferred embodiment, the present disclosure overcomes the above-mentioned disadvantages and meets the recognized need for such an apparatus by providing a facial bone and muscle strengthening apparatus or device which can apply a precise resistance to specific muscles in an exerciser's face and thereby allow an exerciser or their treating physician to increase said resistance in order to increase the exerciser's muscle volume, muscle strength, bone volume, and bone density, thereby decreasing the symptoms of idiopathic and stroke palsy and minimize or even eliminate wrinkles in the exerciser's face.

More specifically, the example embodiments of the present facial bone and muscle strengthening apparatus or device comprises an at least one flexor arm, a flexor head, and a mouthpiece stabilizer. The at least one flexor arm may come in a variety of sizes, shapes, forms, and compositions, but in a potentially preferred embodiment may have an upper component contoured to surround an at least part of a lip of a patient. In this embodiment, the upper component may be perpendicularly connected to a flexing component capable of providing at least one level of resistance against said at least one lip portion. A capability of adjusting the level of resistance of the flexing component is envisioned in order to provide a varying range of resistances against the patient's lip, thereby facilitating a routine to strengthen and grow the subcutaneous muscle and bone over a period of time. In a potentially preferred embodiment, the flexor head may have a size and shape sufficient to secure the assembled apparatus to the face of the patient. This may be accomplished through a variety of ways including, but not limited to, being shaped for the typical contours of a typical patient's teeth or gum impression (for patients with or without teeth, respectively) or by creating a custom impression of an individual patient undergoing treatment based on their individual teeth or gum impression. In this embodiment, when the patient bites down upon the mouthpiece stabilizer, and the apparatus is fully assembled, the mouthpiece stabilizer acts as an anchor to stabilize the entire apparatus during an exercise routine. Therebetween the mouthpiece stabilizer and one or more flexor arms in a potentially preferred embodiment would reside a flexor head. It is envisioned that the flexor head may form a separate or inseparable portion of both the mouthpiece stabilizer and the flexor arm(s), and describing it as a separate component is merely done out of convenience. For instance, the flexor head may be composed of one or more parts, and may be attached to both the flexor arm(s) and the mouthpiece stabilizer, or it may be manufactured as a mere inseparable extension of a flexor arm or the mouthpiece stabilizer. In use, the apparatus may be assembled and the mouthpiece stabilizer portion may be placed within the mouth of the patient, the patient may then bite down on the mouthpiece stabilizer, the patient's lip or lips may be fit around one or more contoured portion(s) of the flexor arm(s), the resistance may be set to a desired level, and the patient may be instructed and so do exercises by moving his or her lips up, down, left, or right, towards, or away from the flexor head of the apparatus. The order of this may be varied and should not be limited to this defined set order in order to be a part of the disclosed exercise or methods of use.

In an exemplary embodiment, the apparatus may include four or more flexor arms. In such an embodiment, the flexor head would have the corresponding number of points to attach the flexor arms. Furthermore, the contoured portions of each flexor arm would be the size and shape sufficient to cover the lips of a patient when they are fully contracted toward the flexor head, without interference of each other. Another feature of this embodiment may be various mechanisms to increase the pressure pushing against the patient's lips and away from the flexor head. This may be accomplished in a variety of biasing ways including adjustable springs, resistance bands, material choices, or hydraulics. Tradeoffs may exist among these choices including the requirement to power the device or to enable the replacement of mechanical parts. In use, this exemplary embodiment may be adjusted to increase pressure and/or resistance against the patient's lips and away from the flexor head, and may be a critical component in an exercise routine to strengthen the muscles and bones of a face of a patient with stroke palsy or idiopathic facial paralysis or a patient seeking cosmetic facial improvement and wrinkle reduction. A patient may visit a doctor or medical professional who may adjust the disclosed apparatus and device according to a treatment plan or a patient may purchase or obtain the disclosed apparatus and adjust it according to a physician recommended plan or plan of their own design. Depending on the necessity for structured and supervised treatment, one skilled in the art may determine what level of structure and supervision might be necessary to properly effectuate the patient's intended results. Through routines tested during development of the disclosed apparatus, patients have demonstrated increased facial strength in both their bones and muscles, have overcome symptoms of stroke and/or idiopathic facial paralysis, and have grown subcutaneous muscle and bone to increase the volume, thereby decreasing deep furrows and fine line wrinkles. These results have been achieved in a limited number of visits and are expected to improve and/or maintain the desired results through continuation of the disclosed exercises using the disclosed apparatus.

In a further exemplary embodiment, the flexor arms may be composed of a flexor arm lip-holder or contoured portion and a flexor arm body, or portion extending perpendicularly from the contoured portion and designed to allow connecting to or assembly with the flexor head. The contoured portion, when viewed from the front of the apparatus, may be in the shape of a U or C or split U or C, or the like or the upside-down or backwards, respectively, versions of each, depending on orientation. The contoured portion, when viewed from the side of the apparatus, may appear J-shaped, in that in an upper lip contoured placement, the higher portion of the contoured portion may face the patient's teeth and the lower portion may face away from the patient, thereby better securing the flexor arm to the patient's lips. This may be reversed if more comfort or other exercises are required. These contoured portions may be built in a variety of shapes and sizes to accommodate specifically sized individual faces, to accommodate various strength training exercises, or may be custom built based on the individual or training plan. The flexor arm body is a portion of the flexor arm that may the same or a separate component of the flexor arm's contoured portion. In this embodiment, the flexor arm body extends perpendicularly from the base of the contoured portion and may be in the shape of a tube or aperture that provides passage for resistance to travel through the arm to the facial muscles. Though the flexor arm may be oriented at any degree around the flexor head, if placed such that the contoured portion rests beneath the patient's upper lip, the flexor arm body may extend downward to the flexor head. In this orientation, the bottom end of the tube may be secured to the flexor head in a variety of ways, including but not limited to, screwing, fusing, gluing, or by being integrally connected and/or being assembled as one component of the apparatus. The flexor arm and its components may be composed of various materials and may be manufactured in a variety of ways. In this embodiment, the contoured portion may be composed of a material comfortable and suitable for placement against a patient's lips and the flexor arm body may be composed of a material sufficiently strong to support its tubular design. Furthermore, the flexor arm body may be composed of a number of parts to accommodate the features of increasing resistance by adjustment and any necessary structures and components to accomplish this feature.

In a further exemplary embodiment, the flexor head or flexor head connector may be composed of one or more component parts. A flexor head connector body may consist of a cylindrical tube with a conduit passage to a plurality of chambers and a flexor head chamber(s). One end of the tube may be open and/or threaded and the other end may be capped or closed-off. The open end may provide sufficient area to house a bias element, such as a spring or an adjustable spring to provide resistance outward from the mouthpiece stabilizer portion. This may require a means to adjust the resistance and thereby increase the range and direction of potential exercises using the disclose apparatus. The flexor head chamber(s) may be positioned radially around the possibly cylindrically-shaped flexor head connector body and may be designed to connect one or more flexor arms. The connections may be formed in a variety of means, including but not limited to, threading. In a potentially preferred embodiment of the flexor head connector, there may be a total of four flexor head connector chambers, each configured to connect a flexor arm, and positioned radially at ninety-degree intervals on the noon/midnight, three o'clock, six o'clock, and nine o'clock positions of the flexor head connector. Positioned and assembled in such a way, a patient may be able to accomplish a range of resistance exercises, including but not limited to, moving their upper and lower lips toward the flexor head connector and moving their left and right cheeks toward the flexor head connector.

In exemplary embodiments, the mouthpiece stabilizer may come in a variety of shapes and sizes and be composed of a variety of materials. The overall shape of such an embodiment may be in the shape of a U, similar to a mouthguard or clear orthodontic retainer. Overall, the mouthpiece stabilizer may serve to anchor and stabilize the apparatus during an exercise, similar to how a bench-press bench stabilizes an exerciser's back and body, or a curl bench stabilizes an exerciser's buttocks, chest, and upper arm to focus an exercise on a number of arm muscles. A component or region of the mouthpiece stabilizer may reside at the front where a patient's front teeth would reside and may be in the shape of a front plate and configured to connect the flexor head connector. Alternatively, the flexor head connector may be fitted to the mouthpiece stabilizer through a hollow or threaded tube for connection to the flexor head connector end chamber. While the composition of the mouthpiece stabilizer may vary and may be composed of individual pieces to form the complete mouthpiece stabilizer, it may be composed of a rigid and strong, yet flexible material sufficient to receive the resistance force during a typical exercise. Alternatively, it may be designed from a comfortable material allowing for better biting grip and a separate and connected material for anchoring to the flexor head connector. In use, the mouthpiece stabilizer may be bitten down upon by the patient during a resistance exercise to hold it in position and align the apparatus.

The disclosed apparatus may function to exercise and thereby strengthen and grow a number of muscles and bones in the human face. Muscles that may be strengthened through various exercises using the disclose apparatus and thereby may treat the symptoms of idiopathic and/or stroke palsy and may decrease or eliminate the cosmetic appearance of wrinkles may include, but are not limited to, the left and right levator libii superioris, levator angul oris, zygomatic minor, zygomaticus major, orbicularis oculi, risorius, depressor anguli oris (triangularis), depressor labii inferioris, and mentalis, as well as the orbicularis oris. Bones that may be strengthened through various exercises using the disclose apparatus and thereby may treat the symptoms of idiopathic and stroke palsy and/or may decrease or eliminate the cosmetic appearance of wrinkles may include, but are not limited to, zygomatic, maxilla, and mandible bone pairs. Positive patient effects of exercises using the disclosed apparatus may include, but are not limited to, reduction or prevention of muscular atrophy due to aging, strengthening and tightening of the above facial muscles, building and growing of the above facial muscles, strengthening and tightening of the above facial bones, building and growing of the above facial bones, increasing total subcutaneous facial volume, prevention of jaw-dropping and/or related involuntary drooling, causing the production and release of hormones that promote the ability of facial muscles to absorb dietary or endogenous amino acids, securing or reducing fatty tissue in the face, promoting muscle and bone growth, and reducing muscle and bone atrophy or breakdown. Cosmetic improvements that may be a result of routine use of the disclosed apparatus in a strength training regimen may include reduction in the appearance of crow's feet, tear trough, nasolabial folds, marionette lines, drooping or prominent jowls, and lip wrinkles. Other cosmetic patient benefits may include, but are not limited to, tightening and smoothing of the skin and reduction/removal/elimination of nasolabial folds, jaw lines, marionette lines, crow's feet, tear trough, and lip wrinkles. Additionally, patients may receive the positive cosmetic effects of the promotion of new facial skin cells through increase facial blood circulation, maintenance of skin elasticity, reduction of stresses on the skin as a result of other environmental factors, and an overall healthier or youthful appearance due to the combination of the above benefits or any benefits not mentioned herein.

These and other features of the apparatus for strengthening facial bones and muscle in cosmetic, stroke, and Idiopathic facial paralysis patients and methods of use will become more apparent to one skilled in the art from the prior Summary and following Brief Description of the Drawings, Detailed Description of exemplary embodiments thereof, and Claims when read in light of the accompanying Drawings or Figures.

BRIEF DESCRIPTION OF THE DRAWINGS

The present facial exercise apparatus and method of use will be better understood by reading the Detailed Description with reference to the accompanying drawings, which are not necessarily drawn to scale, and in which like reference numerals denote similar structure and refer to like elements throughout, and in which.

Figure 1:
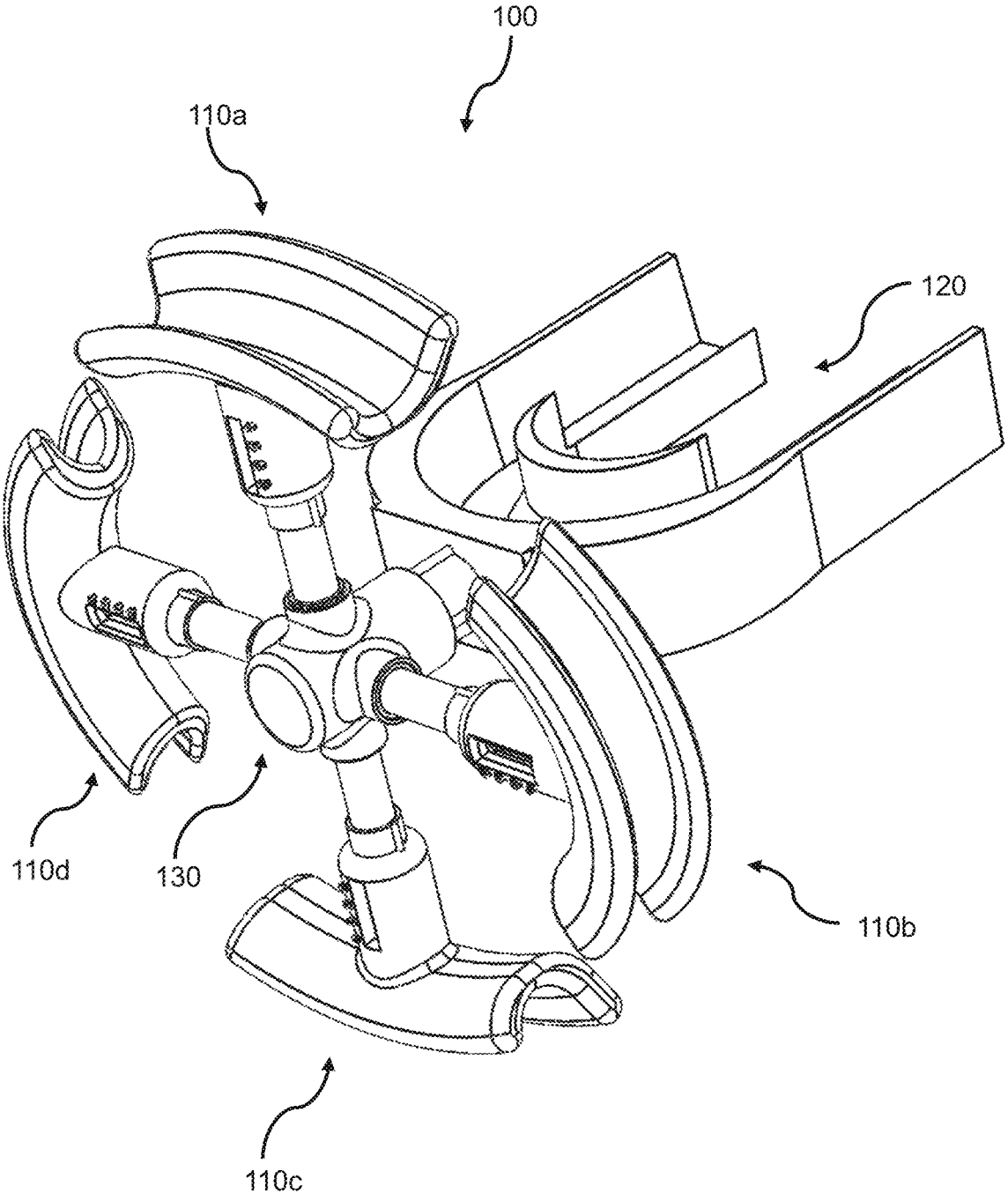
FIG. 1 is an angled perspective view of a preferred embodiment of the disclosed facial exercise apparatus.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

In describing the exemplary embodiments of the present disclosure, as illustrated in FIGS. 1-7, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples. Specifically, the disclosed apparatus or device may be composed of one or many components. Various features and components of the disclosed apparatus may be combined into one or more components such that they have the same or substantially similar properties and functions of the disclosed apparatus. The terms user, patient, and exerciser may be used interchangeably to mean any living human with a face capable of using a device or apparatus as described herein. The method of use of the disclosed device may be described as one in an in- or outpatient setting or in the comfort of the patient's home or other comfortable or otherwise convenient setting. Furthermore, the disclosed device may be manufactured in such a way to be highly customizable and therefore complicated, such that a supervised exercise may be appropriate, or it may be sufficiently universal and simple such that an unsupervised exercise may be appropriate, or combinations thereof.

Referring now to FIGS. 1, 3*a*, 3*b*, 4*a*, and 4*b*, by way of example, and not limitation, therein is illustrated example embodiments of facial exercise apparatus 100. Facial exercise apparatus 100 may be referred herein as just apparatus 100. Apparatus 100 may be used to exercise patient face F. Although patient face F is shown in the drawings resembling feminine features of a healthy young adult female, the disclosure is not so limited, and apparatus 100 may be used to exercise any human patient's face, including, but not limited to: male and female adults, male and female children, male and female elderly adults, or unhealthy and symptomatic humans and combinations thereof.

In one embodiment, apparatus 100 may provide the following elements: flexor arm 110 (see FIGS. 1, 3*a*, 3*b*, 4*a*, 4*b*, 5*a*, and 5*b*), mouthpiece stabilizer 120 (see FIGS. 1, 3*b*, 4*b*, 6*b*, and 7), and a flexor head 130 (see FIGS. 1, 3*a*, 3*b*, 4*a*, 4*b*, 6*a*, and 7). Further enhancing its capabilities, apparatus 100 may further include a plurality of flexor arms including upper flexor arm 110*a*, left flexor arm 110*b*, lower flexor arm 110*c*, and right flexor arm 110*d* (see FIGS. 1, 4*a*, and 4*b*). In addition, one or more flexor arm 110 may include a number of components or parts including flexor arm base connector 112, flexor arm interior compressor rod 114, flexor arm lock 116, flexor arm interior spring 111, flexor arm aperture 113, flexor arm resistance adjustment gauge 191, flexor arm case 119 and flexor arm contoured lip holder 195 having flexor arm lip holder back rear edge 115 and flexor arm lip holder top front edge 117 (see FIGS. 5*a* and 5*b*). Mouthpiece stabilizer 120 may include the areas, regions, parts, and/or components of mouthpiece teeth canal 128, mouthpiece teeth support 121, mouthpiece right arm 124, mouthpiece left arm 126, mouthpiece front plate 125, and mouthpiece connector 122 (see FIGS. 6*b* and 7). Flexor head 130 may include upper flexor head connection port 135*b*, left flexor head connection port 135*a*, right flexor head connection port 135*c*, lower flexor head connection port, flexor head end cap 139, flexor head end chamber 132, and flexor head resistance adjustment gauge panel 192 (see FIGS. 6*a* and 7). Various exercises described in more detail below may have positive effects of strengthening the bone and facial muscles of patient face F and may include the left and right bone pairs of zygomatic bones B1, maxilla bones B2, and mandible bones B3 and left and right muscle pairs of orbicularis M1, levator labil M2, zygomaticus minor M3, zygomaticus major M4, risorius M5, depressor labil inferioris M6, depressor anguli oris M7, and mentalis M8 as well as the orbicularis oris M8 (see FIG. 2). In some embodiments, in order to further enhance the capabilities of apparatus 100, the assembly or connection of mouthpiece stabilizer 120 to flexor head 130 therebetween flexor head end chamber 132 and mouthpiece connector 122 may require or involve flexor head connector rod 134 which may fit within flexor head connector spring 131 (see FIG. 7). Apparatus 100 may generally be assembled by connecting each of one or more flexor arm 110 and mouthpiece stabilizer 120 to flexor head 130 in the manner illustrated in FIG. 1. Each of these constituent parts and components may be manufactured from various materials and require various methods of manufacture to produce apparatus 100, and while examples of such constituent parts and compositions may be described in detail above and below, the disclosed apparatus is not so limited.

In use, in an exemplary embodiment of the disclosed method, apparatus 100 may be secured to patient face F by first placing mouthpiece stabilizer 120 in the mouth of patient face F, and being so stabilized when a patient bites down upon mouthpiece stabilizer 120 (see FIGS. 3*a*, 3*b*, 4*a*, 4*b*, and 8). Once so stabilized, one or each flexor arm 110 may be placed such that flexor arm contoured lip holder 195 partially or substantially surrounds a portion of a lip of patient face F (see FIGS. 3*a*, 3*b*, 4*a*, 4*b*, and 8). Prior to or after this point in an exemplary embodiment of the disclosed method, the resistance of flexor arm 110 against a lip of patient face F may be adjusted or the measurement of the present resistance against a lip of patient face F may be viewed using flexor arm resistance adjustment gauge 191. An exemplary exercise that may be made possible as a result of the disclosed method may be performed by one or repetitive movements of the lip(s) of patient face F toward and away from flexor head 130, when the lip(s) of patient face F is so placed and/or fitted along flexor arm contoured lip holder 195 (FIGS. 3*a*, 3*b*, 4*a*, 4*b*, and 8), thereby moving the lip(s) of patient face F (such as open lips and closure of lips) against the resistance created by flexor arm 110, contracting and extending flexor arm 110 (compare FIGS. 4*a* and 4*b* or FIGS. 4*a* and 4*b*), and causing the various muscles, muscle groups, and bone pairs to engage in strength training exercises (see FIGS. 3*a*, 3*b*, 4*a*, 4*b*, and 8).

Referring now specifically to FIG. 1, therein is illustrated an angled perspective view of a preferred embodiment of apparatus 100. One or more flexor arm 110 and mouthpiece stabilizer 120 may be connected via flexor head 130. Therein illustrated in FIG. 1 are upper flexor arm 110*a*, left flexor arm 110*b*, lower flexor arm 110*c*, and right flexor arm 110*d*. One or more flexor arm 110 may be substantially T-shaped, where the horizontal portion of the T may be so curved or contoured to comfortably fit a human lip and the vertical portion of the T may be substantially straight, the flexor arm 110 having a base with a means to connect to flexor head 130 and a contoured portion along the top designed and composed of materials to fit comfortably around a lip portion of patient face F. Mouthpiece stabilizer 120 may be U-shaped in order to comfortably and securely stabilize apparatus 100 into the mouth of patient face F, where a means to connect to flexor head 130 may be placed at the portion of mouthpiece stabilizer 120 so facing the front of patient face F. When so assembled into apparatus 100, flexor head 130 may extend cylindrically from its connection to mouthpiece stabilizer 120 outward and may contain one or more connections to accommodate one or more flexor arm 110 radially at approximately ninety-degree intervals around its cylindrical portion. Apparatus 100 may be assembled from one or more flexor arm 110, mouthpiece stabilizer 120, and flexor head 130 and each may be so detachably connected or each may be permanently fused or otherwise inseparably connected. Each of these constituent parts and components of apparatus 100 may be composed of various materials and require various methods of manufacture to produce apparatus 100, and while such constituent parts and compositions may be described in detail above and below, the disclosed apparatus is not so limited. Various other components or sub-pieces of one or more flexor arm 110, mouthpiece stabilizer 120, and flexor head 130 of a possibly preferred apparatus 100 may be identifiably illustrated therein FIG. 1, which are described in more detail below according to more detailed illustrations.

Figure 2:
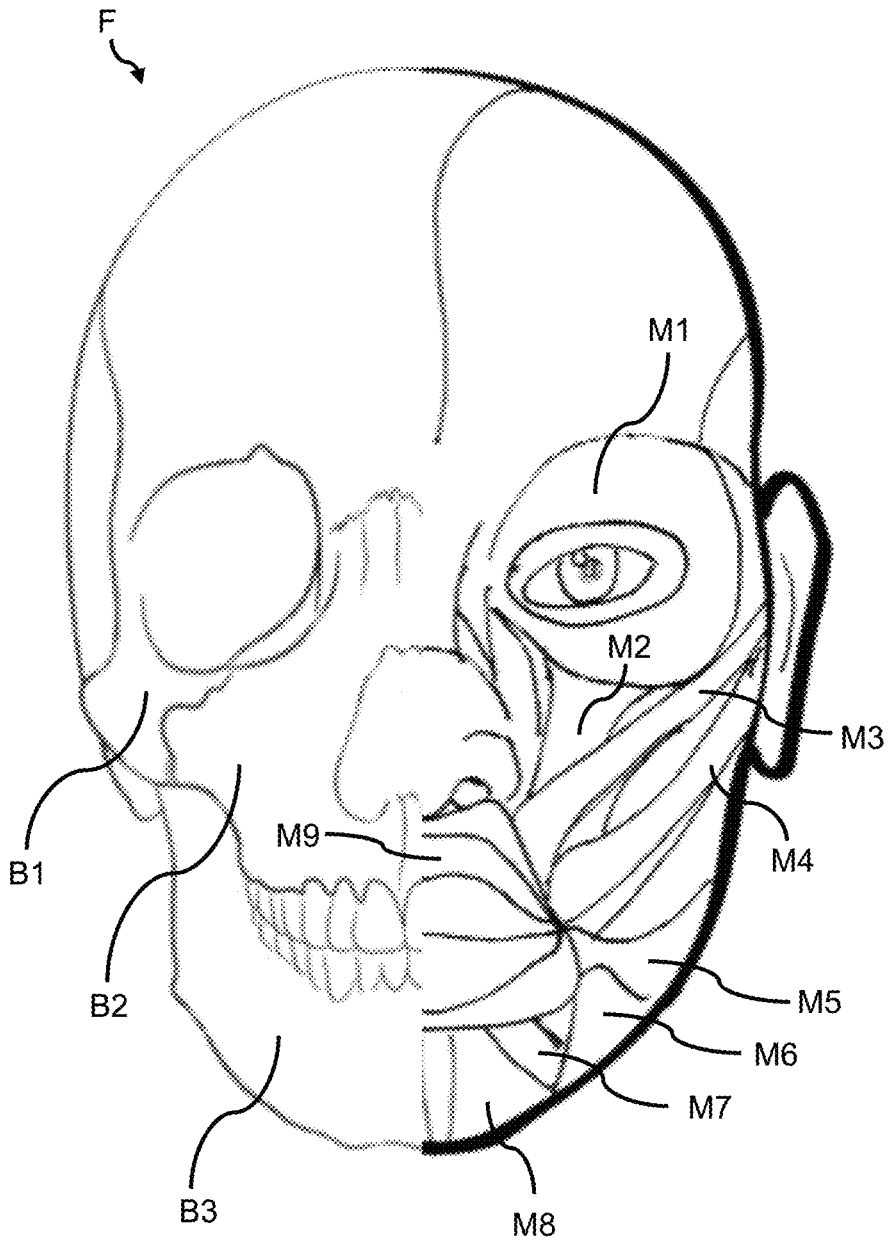
FIG. 2 is an anatomical drawing of an exemplary right half of a patient's skull and left half of a patient's muscles from a front perspective cut-away view.

Referring now specifically to FIG. 2, therein is illustrated an anatomical drawing of an exemplary patient face F, the left half showing the right half of a patient's skull and the right half showing the left half of a patient's muscles from a front perspective anatomical cut-away view. The anatomical drawing of FIG. 2 is provided for illustrative purposes and the human face, and its muscles and bones, are not claimed as part of apparatus 100, but may be involved or required to exercise in the performing of method steps 810-850. Starting at the top of patient face F, on the left side of the anatomical drawing and the right side of patient face F may be found the right zygomatic bone B1, right maxilla bone B2, and right mandible bone B3. Each of these bones exist in pairs in a skull of a typical patient face F, each having a substantially similar, though mirror imaged left version. Starting at the top of patient face F, on the right side of the anatomical drawing and the left side of patient face F, may be found the muscles of left orbicularis M1, left levator labil M2, left zygomaticus minor M3, left zygomaticus major M4, left risorius M5, left depressor labil inferioris M6, left depressor anguli oris M7, and let mentalis M8 as well as the muscle orbicularis oris M8. Each left muscle illustrated therein FIG. 2 exist in pairs in a typical patient face F, each right muscle having a substantially similar, though mirror imaged right version. Each of these bones and muscles are important to providing the structure, support, strength, and appearance of a human face. Through use of apparatus 100 using the method steps 810-850, a patient may be able to strengthen, tone, define, and grow each of the various muscles illustrated therein FIG. 2, thereby strengthening the structure of patient face F, increasing the support provided to various features of patient face F, strengthening the bones and muscles of patient face F therein illustrated in FIG. 2, and bettering the cosmetic appearance of patient face F by increasing and toning the subcutaneous volume beneath the skin of patient face F.

Figure 3A:
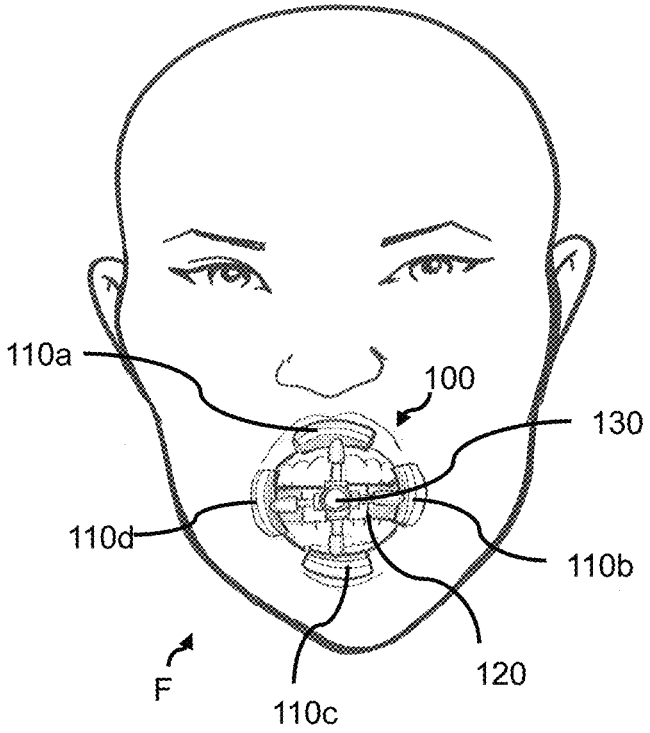
FIG. 3*a* is a front view of a patient using a preferred embodiment of the disclosed facial exercise apparatus.

Referring now specifically to FIG. 3*a*, therein is illustrated a front view of a patient face F using a preferred embodiment of apparatus 100. One or more flexor arm 110 and mouthpiece stabilizer 120 may be connected via flexor head 130. Therein illustrated in FIG. 3*a* are upper flexor arm 110*a*, left flexor arm 110*b*, lower flexor arm 110*c*, and right flexor arm 110*d*, each being placed on an upper lip portion, a left lip portion, bottom lip portion, and a right lip portion of patient face F, respectively. One or more flexor arm 110 may be substantially T-shaped, where the horizontal portion of the T may be so curved or contoured to comfortably fit a human lip and the vertical portion of the T may be substantially straight, the flexor arm 110 having a base with a means to connect to flexor head 130 and a contoured portion along the top designed and composed of materials to fit comfortably around a lip portion of patient face F. Mouthpiece stabilizer 120 may be U-shaped in order to comfortably and securely stabilize apparatus 100 into the mouth of patient face F, as one would a protective or corrective mouthpiece, where a means to connect to flexor head 130 may be placed at the portion of mouthpiece stabilizer 120 so facing the front of patient face F. When so assembled into apparatus 100, flexor head 130 may extend cylindrically from its connection to mouthpiece stabilizer 120 outward and may contain one or more connections to accommodate one or more flexor arm 110 radially around its cylindrical portion. Each of these constituent parts and components of apparatus 100 may be composed of various materials and require various methods of manufacture to produce apparatus 100, and while such constituent parts and compositions may be described in detail above and below, the disclosed apparatus is not so limited. Various other components or sub-pieces of one or more flexor arm 110, mouthpiece stabilizer 120, and flexor head 130 of a possibly preferred apparatus 100 may be identifiably illustrated therein FIG. 3*a*, which are described in more detail below according to more detailed illustrations.

It is contemplated herein that other combination, such as a six-flexor arm 110 and flexor head 130 and each being placed on an upper lip portion, an upper left lip portion, an upper right portion, bottom lip portion, a bottom left lip portion, and a bottom right lip portion of patient face F, respectively.

Figure 3B:
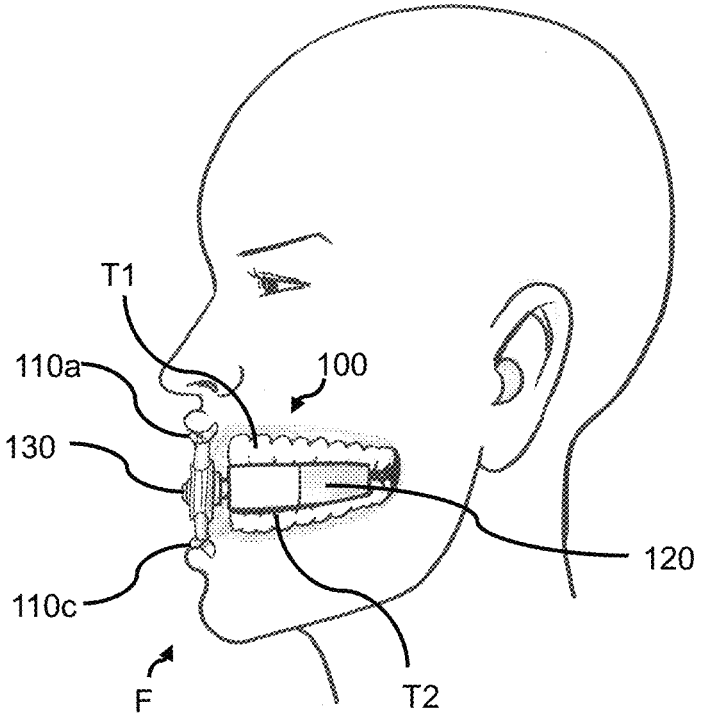
FIG. 3*b* is a side cut-away view of a patient using a preferred embodiment of the disclosed facial exercise apparatus.

Referring now specifically to FIG. 3*b*, therein is illustrated a side cut-away view of patient face F using a preferred embodiment of apparatus 100. One or more flexor arm 110 and mouthpiece stabilizer 120 may be connected via flexor head 130. Therein illustrated in FIG. 3*b* are upper flexor arm 110*a* and lower flexor arm 110*c*, each being placed on an upper lip portion and bottom lip portion of patient face F, respectively. One or more flexor arm 110 may be substantially T-shaped, where the horizontal portion of the T may be so curved or contoured to comfortably fit a human lip and the vertical portion of the T may be substantially straight, the flexor arm 110 having a base with a means to connect to flexor head 130 and a contoured portion along the top designed and composed of materials to fit comfortably around a lip portion of patient face F. Mouthpiece stabilizer 120 may be U-shaped in order to comfortably and securely stabilize apparatus 100 into the mouth of patient face F, where a means to connect to flexor head 130 may be placed at the portion of mouthpiece stabilizer 120 so it faces outward from the front of patient face F from mouthpiece stabilizer 120. The patient may further secure apparatus 100 to patient face F by biting down upon mouthpiece stabilizer 120, and by so doing causing their upper teeth T1 to move downward upon mouthpiece stabilizer 120 and their lower teeth T2 to move upward upon mouthpiece stabilizer 120, thereby causing a pinching force upon mouthpiece stabilizer 120 in order to further stabilize apparatus 100. When assembled into apparatus 100, flexor head 130 may extend cylindrically from its connection to mouthpiece stabilizer 120 outward and may contain one or more connections to accommodate one or more flexor arm 110 radially around its cylindrical portion. Apparatus 100 may be assembled from one or more flexor arm 110, mouthpiece stabilizer 120, and flexor head 130 and each may be so detachably connected or each may be permanently fused or otherwise inseparably connected. Each of these constituent parts and components of apparatus 100 may be composed of various materials and require various methods of manufacture to produce apparatus 100, and while such constituent parts and compositions may be described in detail above and below, the disclosed apparatus is not so limited. Various other components or sub-pieces of one or more flexor arm 110, mouthpiece stabilizer 120, and flexor head 130 of a possibly preferred apparatus 100 may be identifiably illustrated therein FIG. 3*b*, which are described in more detail below according to more detailed illustrations.

Figure 4A:
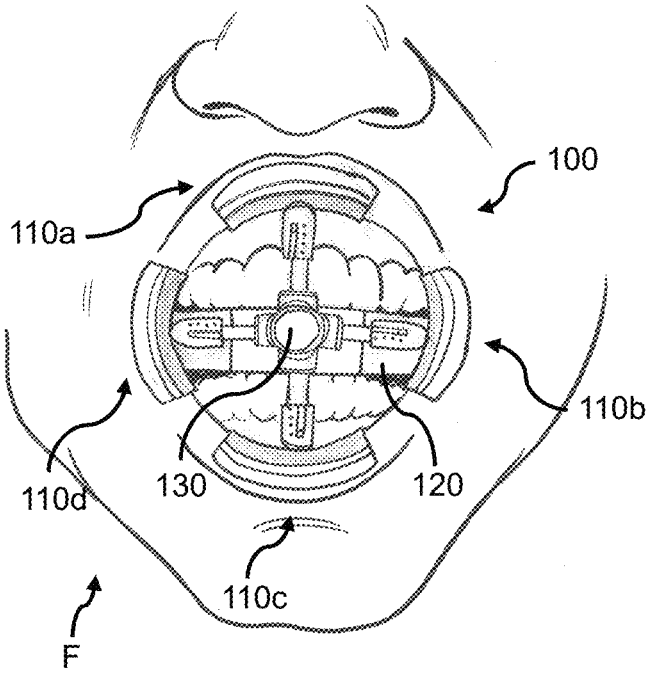
FIG. 4*a* is a front view of a patient using a preferred embodiment of the disclosed facial exercise apparatus with four flexor arms in the decompressed position.
Figure 4B:
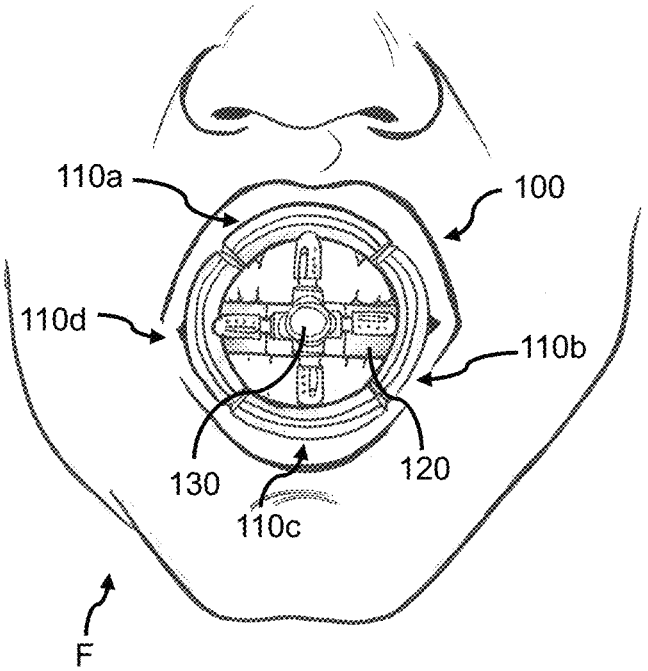
FIG. 4*b* is a front view of a patient using a preferred embodiment of the disclosed facial exercise apparatus with four flexor arms in the compressed position.

Referring now specifically to FIGS. 4*a* and 4*b*, therein are illustrated a front view of a patient face F using a preferred embodiment of apparatus 100 with flexor arm 110*a*, left flexor arm 110*b*, lower flexor arm 110*c*, and right flexor arm 110*d*, each being placed on an upper lip portion, a left lip portion, bottom lip portion, and a right lip portion of patient face F, respectively, each flexor arm 110 in a decompressed position in FIG. 4*a* and in a compressed position in FIG. 4*b*. As illustrated, one or more flexor arm 110 may be substantially T-shaped, where a horizontal portion of the T may be so curved or contoured to comfortably fit a human lip and a vertical portion of the T may be substantially straight, each flexor arm 110 having a base with a means to connect to flexor head 130 and a contoured portion along the top designed and composed of materials to fit comfortably around a lip portion of patient face F. Since a horizontal portion of a T-shaped flexor arm 110, flexor arm lip holder assembly 118, may be designed such that it may extend and contract along a vertical portion of a T-shaped flexor arm 110, each flexor arm 110 may be extended outward from flexor head 130 as illustrated in FIG. 4*a* or may be contracted inward toward flexor head 130 as illustrated in FIG. 4*b*. By moving one or more flexor arm 100 inward toward flexor head 130, and outward away from flexor head 130, a patient face F may perform an exercise. By doing so repetitively, routinely, and as a part of a program to increase the strength, size, tone, and structure of the muscles of patient face F. By providing a mechanism to provide and/or increase a resistance outward from flexor head 130 therebetween a horizontal portion of the T, or flexor arm lip holder assembly 118, and a vertical portion of the T in one or more T-shaped flexor arm 110, such a repetitive or routine exercise program may offer increasingly noticeable results. Other components of apparatus 100 and their corresponding characteristics may be important to securing apparatus 100 to patient face F to perform an exercise using apparatus 100. Mouthpiece stabilizer 120 may be U-shaped in order to comfortably and securely stabilize apparatus 100 into the mouth of patient face F, where a means to connect to flexor head 130 may be placed at the portion of mouthpiece stabilizer 120 so facing the front of patient face F. When assembled into apparatus 100, flexor head 130 may extend cylindrically from its connection to mouthpiece stabilizer 120 outward and may contain one or more connections to accommodate one or more flexor arm 110 radially around its cylindrical portion. Various components and materials may be employed to allow travel of a horizontal portion of the T along the vertical portion of the T in a T-shaped flexor arm 110, which can be apparent from the details covered more specifically in other figures below.

Figure 5A:
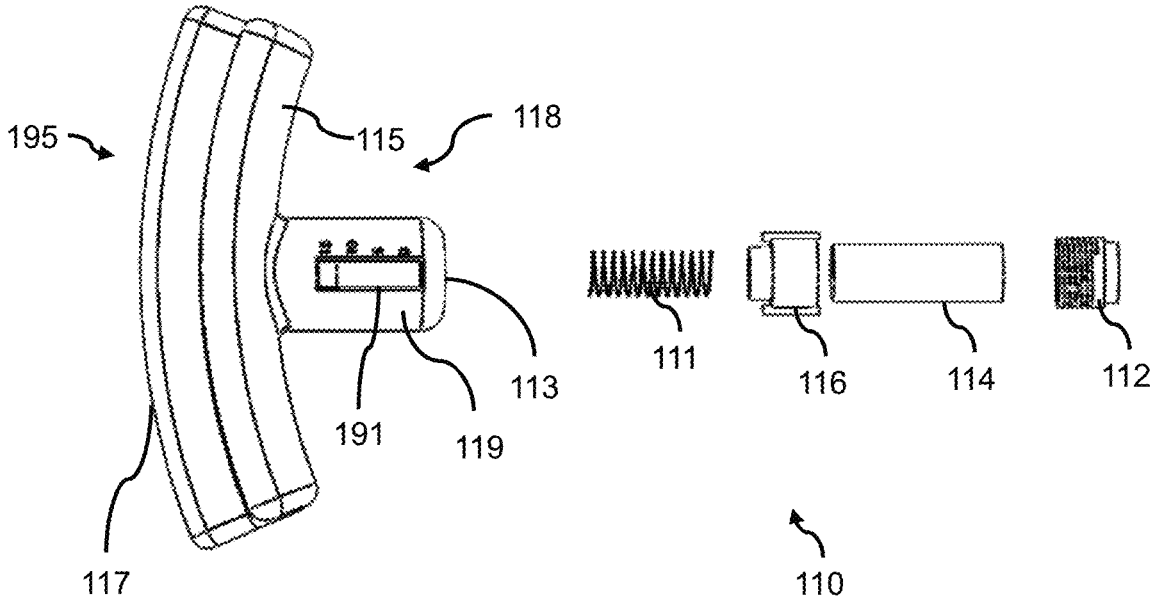
FIG. 5*a* is an exploded view of a preferred embodiment of a flexor arm of the disclosed facial exercise apparatus.
Figure 5B:
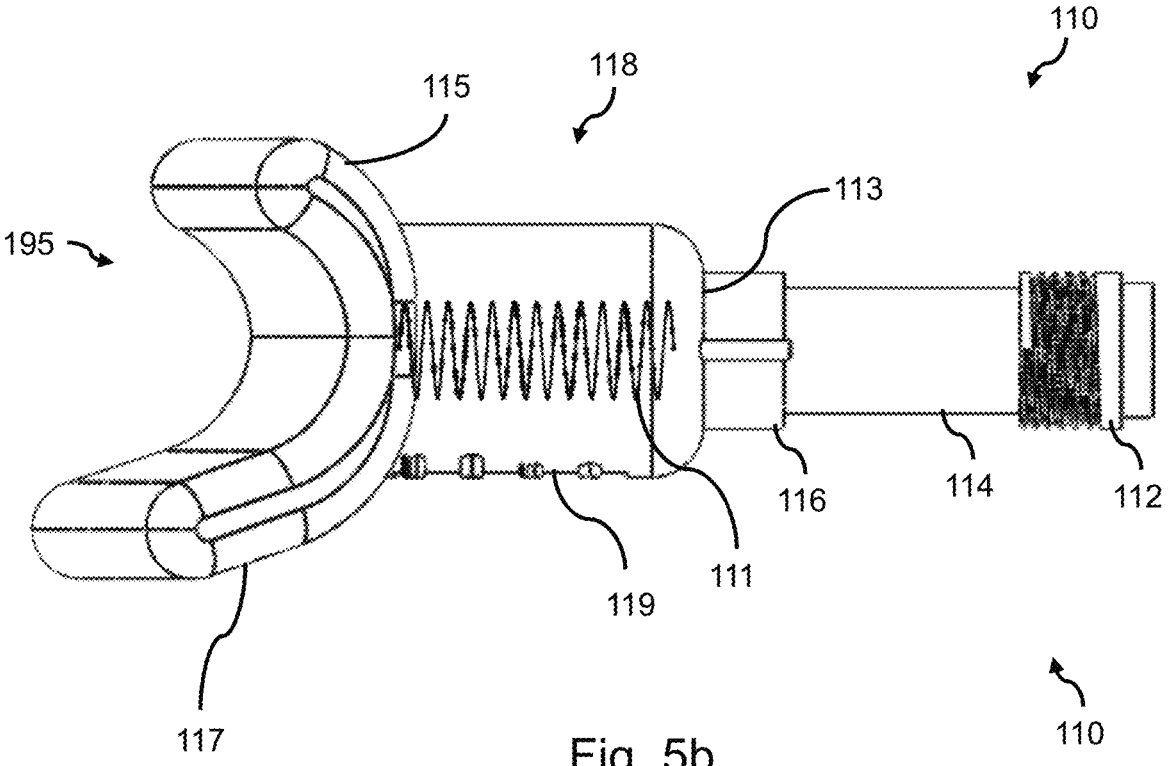
FIG. 5*b* is a cross-sectional view of a preferred embodiment of a flexor arm of the disclosed facial exercise apparatus.

Referring now specifically to FIGS. 5*a* and 5*b*, therein are illustrated an exploded view of a flexor arm 110 of a preferred embodiment of apparatus 100 and an assembled view of the same. As shown in figures described above, apparatus 100 may feature one or more flexor arm 110 which may be connected radially along the cylindrical portion of flexor head 130. Each flexor arm 110 may be further composed of constituent parts in order to perform the desired functions of apparatus 100. As illustrated in a disassembled state in FIG. 5*a* and in an assembled state in FIG. 5*b*, preferred embodiments of these component parts of flexor arm 110, from right to left in the drawings, may include flexor arm base connector 112, flexor arm interior compressor rod 114, flexor arm lock 116, flexor arm bias element, such as interior spring 111, flexor arm aperture 113, and flexor arm lip holder assembly 118. Flexor arm lip holder assembly 118 may further include the parts, components, portions and/or regions of flexor arm resistance adjustment gauge 191, flexor arm case 119, and flexor arm contoured lip holder 195 having flexor arm lip holder back rear edge 115 and flexor arm lip holder top front edge 117. Flexor arm lip holder assembly 118, when viewed from the side, may appear substantially J-shaped, having one side extending higher than the other. Depending on the desired comfort and exercises for the patient, a higher side may be placed either closer to the teeth or closer to the outer lip and flexor arm 110 or flexor arm lip holder assembly 118 may be manufactured to allow for rotating flexor arm 110 to accommodate such desires. When assembled, as illustrated in FIG. 5*b*, flexor arm base connector 112 may secure flexor arm interior compressor rod 114 which may then be connected movably to flexor arm lock 116. Flexor arm interior spring 111 may fit within flexor arm case 119 and against flexor arm lock 116 when flexor arm interior spring 111 is placed through flexor arm aperture 113. Resistance in flexor arm 110 during its compression may be provided by the force generated by flexor arm interior spring 111 when a lip portion of patient face F causes pressure against flexor arm contoured lip holder 195 and toward flexor head 130, thereby causing the movable connection of flexor arm lock 116 to move along flexor arm interior compressor rod 114 and thereby causing flexor arm interior spring 111 to compress and generate a corresponding force. Additionally, a mechanism may be provided to allow for an increase or a decrease in the spring force of flexor arm interior spring 111 through adjustment of flexor arm resistance adjustment gauge 191, thereby requiring a correspondingly additional or diminished pressure against flexor arm contoured lip holder 195 in order to move flexor arm lip holder assembly 118 toward flexor head 130. Each flexor arm 110 may be adjusted individually to accommodate the exercise required for its corresponding lip portion. Flexor arm 110 and various component parts of a preferred embodiment as illustrated therein FIGS. 5*a* and 5*b* may include or be manufactured from many contemplated compositions. By way of example and not limitation, flexor arm contoured lip holder 195 may be composed of a material that may rest comfortably against patient face F, such as a medical grade plastic or a siliconized or rubberized material. Furthermore, flexor arm lip holder assembly 118 may include one or more of a variety of materials and may even be manufactured as a single component, if so desired. While a preferable durable material for manufacture of flexor arm interior spring 111 may be a flexible metal alloy, flexor arm interior spring 111 may be manufactured from any number of materials known by one skilled in the art as appropriate for manufacturing a spring. Each remaining component of flexor arm 110 may be manufactured from metal or plastic, or other suitable materials and combinations thereof. It is contemplated that flexor arm lock 116 and flexor arm lip holder assembly 118 as well as flexor arm interior compressor rod 114 and flexor arm base connector 112 may be formed as one component or may be caused to become inseparably fused during manufacture and/or assembly. Additionally, each component of flexor arm 110 may be connected or assembled in a variety of ways including adhesion, male-to-female threading, or other methods of detachable or irreversible assembly known to those skilled in the art and/or combinations thereof.

Figure 6A:
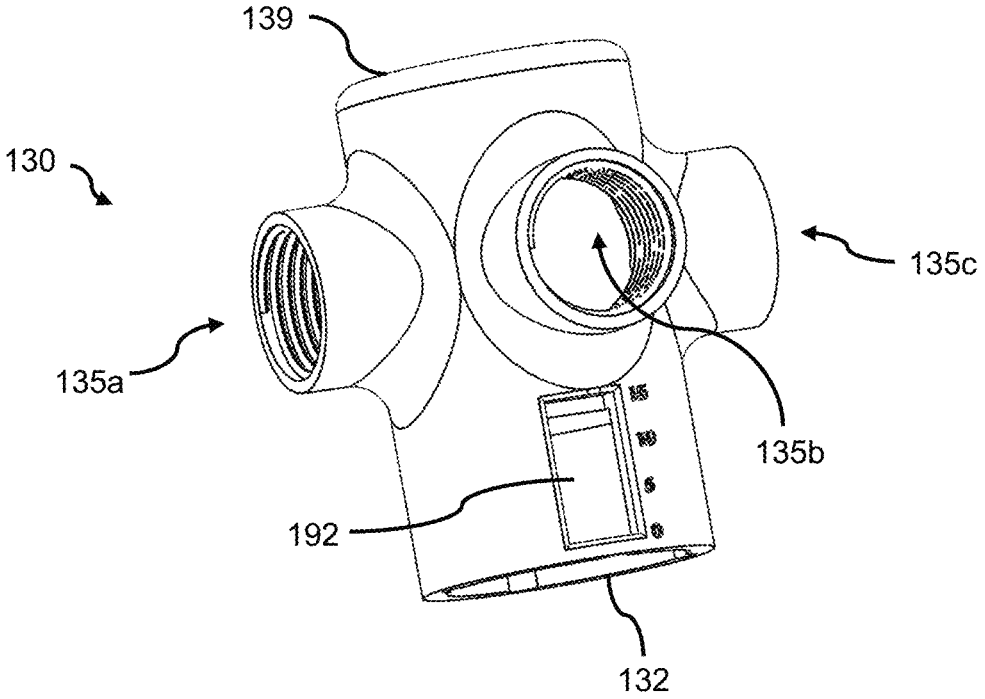
FIG. 6*a* is a top-angled perspective view of a preferred embodiment of a flexor head connector of the disclosed facial exercise apparatus.
Figure 6B:
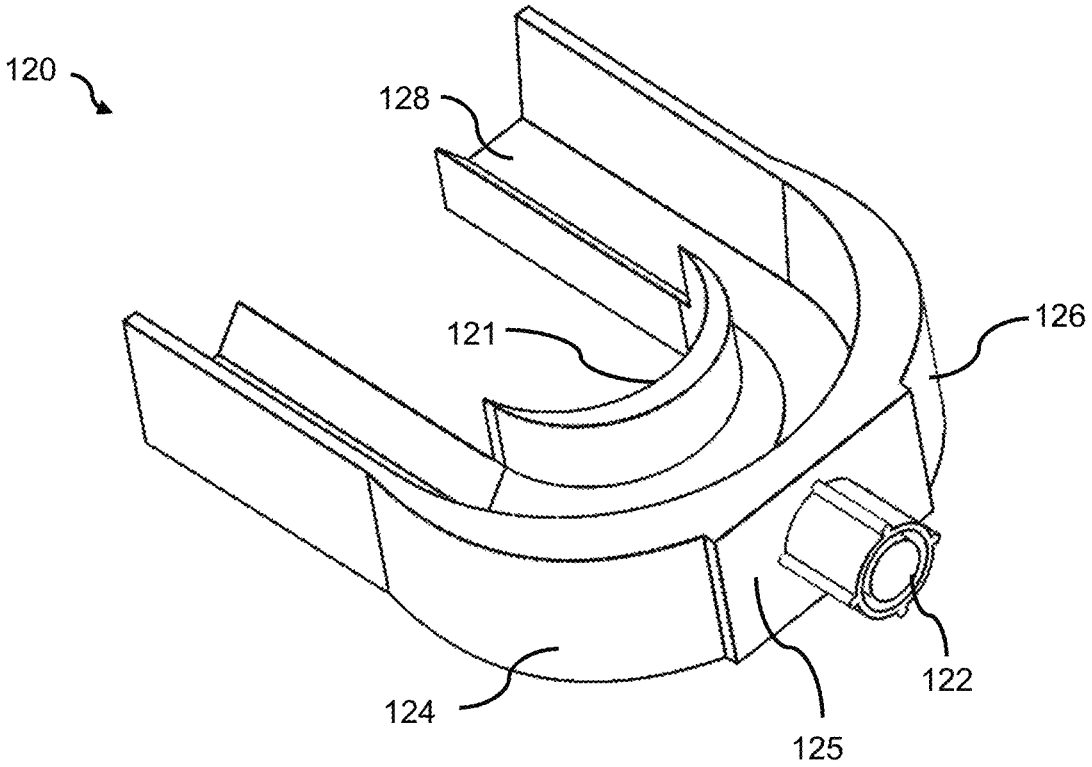
FIG. 6*b* is a top-angled perspective view of a preferred embodiment of a mouthpiece stabilizer of the disclosed facial exercise apparatus.

Referring now specifically to FIGS. 6*a* and 6*b*, therein are illustrated a top-angled perspective view of flexor head 130 and mouthpiece stabilizer 120 of a potentially preferred embodiment of apparatus 100. Flexor head 130, in a potentially preferred embodiment as illustrated in FIG. 6*a*, may include upper flexor head connection port 135*b*, left flexor head connection port 135*a*, right flexor head connection port 135*c*, lower flexor head connection port (not shown), flexor head end cap 139, flexor head end chamber 132, and flexor head resistance adjustment gauge panel 192. Flexor head 130 may form an overall substantially cylindrical shape with flexor head end cap 139 facing away from flexor end chamber 132. Radially around flexor head 130 may exist one or more apertures capable of receiving and/or connecting to flexor arm 110. These apertures may include upper flexor head connection port 135*b*, left flexor head connection port 135*a*, right flexor head connection port 135*c*, lower flexor head connection port (not shown), flexor head end cap 139. Each aperture may connect to one or more flexor arm 110, through a variety of means known to one skilled in the art including, but not limited to, threading as illustrated. Flexor head 130 may also include flexor head resistance adjustment gauge panel 192, which may allow for the adjustment of pressure outward from mouthpiece stabilizer 120, as described below and illustrated in more detail in FIG. 7. Flexor head adjustment gauge panel 192 may either allow for the monitoring of force or pressure between mouthpiece stabilizer 120 and flexor head 130, or may be used for the adjustment of the force or pressure between the same. Flexor head 130, and its listed components or parts may be manufactured from materials known by one skilled in the art to be appropriate for use in an exercise, medical or dental setting, including but not limited to medical grade metal alloy or plastic, and may each exist as separate assembled parts or may be manufactured as a single component, and/or combinations thereof. Mouthpiece stabilizer 120, in a potentially preferred embodiment as illustrated in FIG. 6*b*, may include the areas, regions, parts, and/or components of mouthpiece teeth canal 128, mouthpiece teeth support 121, mouthpiece right arm 124, mouthpiece left arm 126, mouthpiece front plate 125, and mouthpiece connector 122. Mouthpiece stabilizer 120 may further include a small connecting portion protruding from mouthpiece front plate 125, upon which may be connected and/or affixed mouthpiece connector 122. Mouthpiece stabilizer 120 may be substantially U-shaped and may be manufactured according to best accommodate the size and shape of a typical adult human. Alternatively, mouthpiece stabilizer 120 may manufactured in a variety of shapes and sizes and may even be custom manufactured for individual patients based on molds, molded impressions, or otherwise formed impressions of a patient's bite pattern, similar to how custom dentures or "invisible" orthodontia may be manufactured, in order to better secure apparatus 100 during use. The areas, regions, parts, and/or components of mouthpiece stabilizer 120, which may include mouthpiece teeth canal 128, mouthpiece teeth support 121, mouthpiece right arm 124, mouthpiece left arm 126, mouthpiece front plate 125, and mouthpiece connector 122, may be formed from individual parts and assembled into one unit or may be manufactured as one component of apparatus 100, and/or combinations thereof. Mouthpiece stabilizer 120, and its listed components, may be manufactured from one or more suitable materials including but not limited to medical or dental grade plastic or a siliconized or rubberized material such that it may be preferable to manufacture in order to provide increased comfort and stability to a patient during use. Flexor head end chamber 132 may be designed to receive and connect securely to mouthpiece stabilizer 120 at mouthpiece connector 122 through a variety of mechanisms that may be apparent to one skilled in the art including, but not limited to, threading or a push in and turn to lock mechanism with female notches radially within flexor head end chamber 132 capable of receiving corresponding protruding radially arranged male portions of mouthpiece connector 122. It is further contemplated that female notches radially within flexor head end chamber 132 may be more numerous than protruding radially arranged male portions of mouthpiece connector 122, thereby allowing for more numerous arrangements of radially extending one or more flexor arm 110, i.e. be removed spun at increments of e.g. 45 degrees. It is contemplated herein that flexor head 130 and mouthpiece stabilizer 120 may be manufactured as one component or may include two or even several substituent components which may be assembled. While as illustrated herein, flexor head 130 is substantially cylindrical, it is contemplated herein that flexor head 130 may come in a variety of three-dimensional shapes including, but not limited to triangular, rectangular, or other polygonal prisms. Furthermore, while flexor head 130 is illustrated herein to include three shown and four total flexor head connection ports, one skilled in the art may recognize the need for more or fewer such ports to accommodate more or fewer flexor arms 110, depending on a variety of factors. The disclosure is not so limited to the example illustrated provided and the corresponding description.

Figure 7:
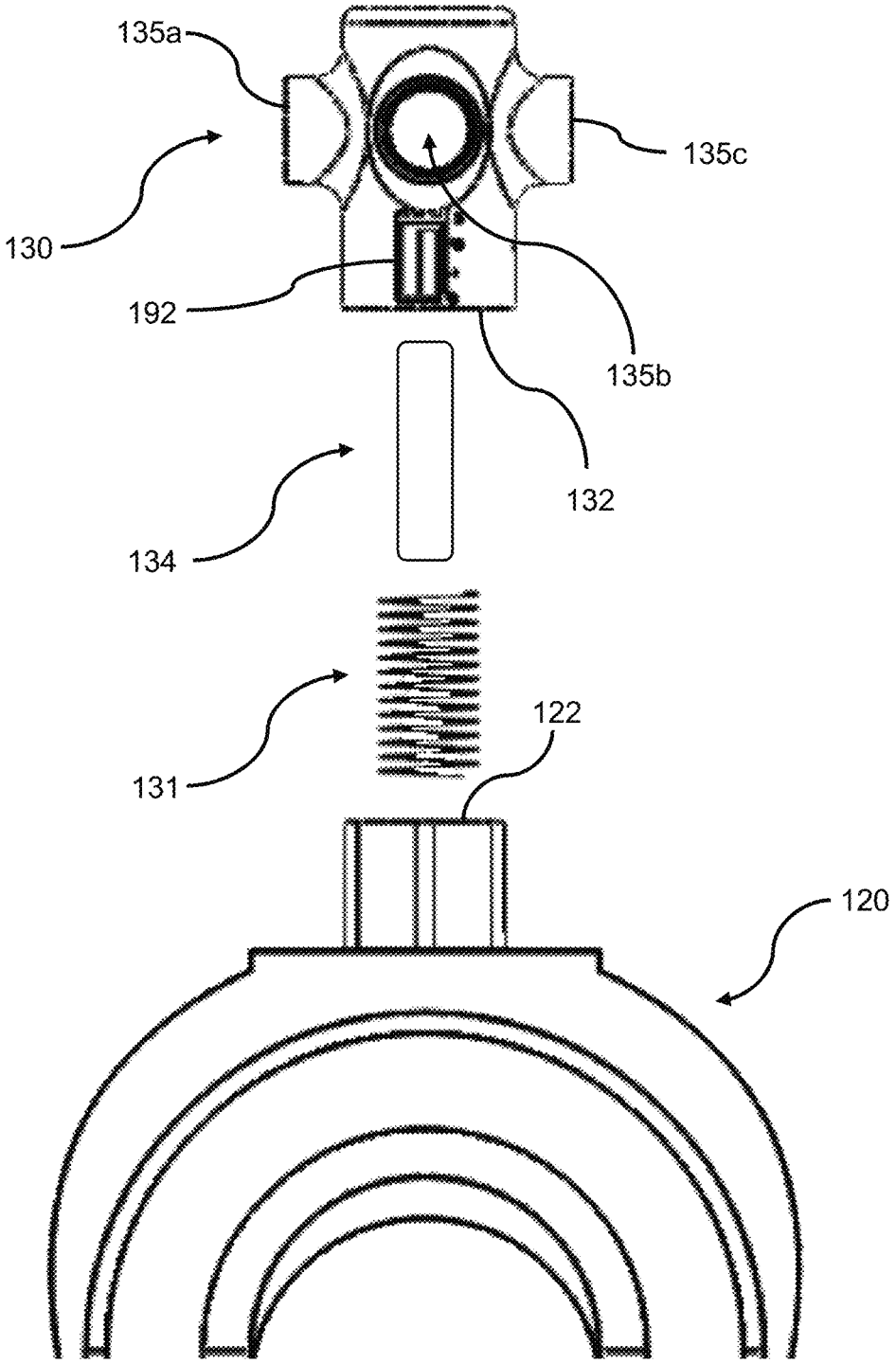
FIG. 7 is an exploded view of a preferred embodiment of a mouthpiece stabilizer when disassembled from a flexor head connector of the disclosed facial exercise apparatus.

Referring now specifically to FIG. 7, therein is illustrated an exploded view of a optional embodiment of mouthpiece stabilizer 120 when disassembled from flexor head 130 to expose optional included features of an optional embodiment. Flexor head 130, in an optionally preferred embodiment as illustrated in FIG. 7, may include upper flexor head connection port 135*b*, left flexor head connection port 135*a*, right flexor head connection port 135*c*, lower flexor head connection port (not shown), flexor head end cap 139, flexor head end chamber 132, and flexor head resistance adjustment gauge panel 192. Flexor head 130 may form an overall substantially cylindrical shape with flexor head end cap 139 facing away from flexor end chamber 132. Radially around flexor head 130 may exist one or more apertures capable of receiving and/or connecting to flexor arm 110. These apertures may include upper flexor head connection port 135*b*, left flexor head connection port 135*a*, right flexor head connection port 135*c*, lower flexor head connection port (not shown), flexor head end cap 139. Each aperture may connect to one or more flexor arm 110, through a variety of means known to one skilled in the art including, but not limited to, threading as illustrated in FIG. 6*a*. Flexor head 130 may also include flexor head resistance adjustment gauge panel 192, which may allow for the adjustment of pressure outward from mouthpiece stabilizer 120. Mouthpiece stabilizer 120 may be substantially U-shaped and may be manufactured according to best accommodate the size and shape of a typical adult human. Alternatively, mouthpiece stabilizer 120 may manufactured in a variety of shapes and sizes and may even be custom manufactured for individual patients based on molds or impressions of a patient's bite pattern, similar to how custom dentures or "invisible" orthodontia may be manufactured, in order to better secure apparatus 100 during use. Mouthpiece stabilizer may include mouthpiece connector 122, which may be formed from individual parts and assembled into one unit or may be manufactured as one component of apparatus 100, and/or combinations thereof. In the potentially preferred embodiment illustrated in FIG. 7 therebetween flexor head 130 and mouthpiece stabilizer 120 may exist flexor head connector rod 134 which may fit within or press against flexor head connector spring 131 when assembled, thereby generating a force either inward toward mouthpiece stabilizer 120 or outward away from mouthpiece stabilizer 120, depending on configuration. Resistance adjustment gauge panel 192 may be configured to either monitor resistance generated by a patient during exercise or to increase or decrease resistance of the mechanism. With this optional feature, a patient may perform additional exercises by utilizing the inward or outward force and resisting it, thereby exercising additional muscle and bone structures of patient face F.

Figure 8:
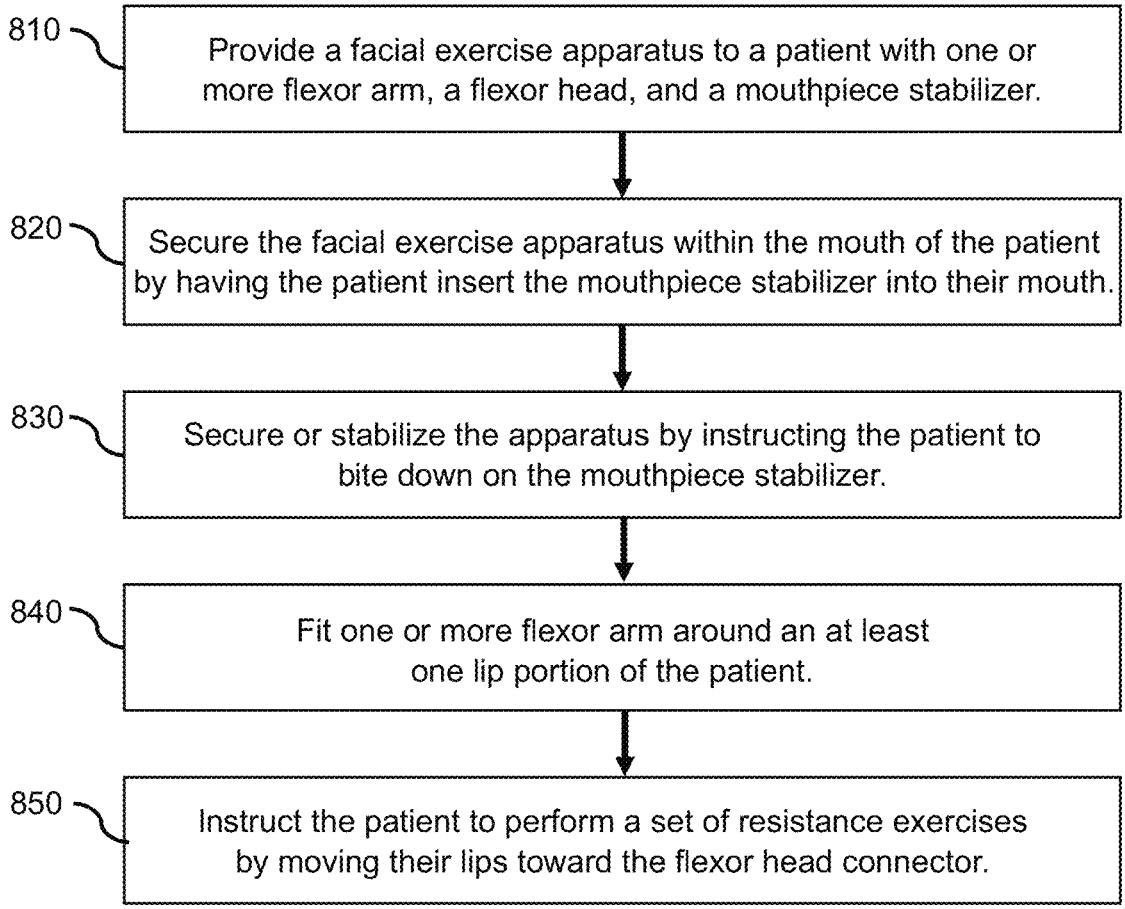
FIG. 8 is a flowchart of an exemplary embodiment of securing the disclosed apparatus to a patient in order to perform the disclosed exercises.

Referring now specifically to FIG. 8, therein is illustrated a flowchart of an exemplary embodiment of the disclosed exercise method. Each step in the disclosed method may be performed by a medical professional, a dental professional, an instructor, a supervisor, or the patient her or himself, and/or combinations thereof. At first exercise method step 810, one may provide apparatus 100, as described herein, to a patient. Apparatus 100 may include one or more flexor arm 110, flexor head 130, and a mouthpiece stabilizer 120. Then, at second method step 820, one may secure apparatus 100 within the mouth of the patient by having the patient insert mouthpiece stabilizer 120 into the mouth of patient face F. At third method step 830, securing or stabilizing apparatus 100 may be accomplished by instructing the patient to bite down on mouthpiece stabilizer 120. Once so secured, at fourth method step 840, one may fit one or more flexor arm 110 around an at least one lip portion of patient face F. Finally, one may, at fifth method step 850, instruct the patient to perform a set of resistance exercises by moving their lips or portions of lips toward the flexor head 130 and the patient may so do, thereby causing facial exercises of the disclosed method to be performed.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein, but is limited only by the following claims.

What is claimed is:

1. A facial exercise apparatus to perform resistance exercises for an at least one portion of a lip a patient, the apparatus comprising:

an at least one flexor arm, said at least one flexor arm having an upper component contoured to surround the at least one portion of the lip of the patient, perpendicularly connected to a flexing component capable of providing an at least one level of resistance against the at least one lip portion;

an at least one flexor head having a substantially cylindrical portion, a front end and rear end, said flexor head capable of receiving said at least one flexor arm on an at least one location along said substantially cylindrical portion of said at least one flexor head; and a mouthpiece stabilizer having a size and shape sufficient to secure said apparatus to said face of said patient when said patient bites down upon said mouthpiece stabilizer, said mouthpiece stabilizer capable of connecting to said flexor head at said rear end wherein said flexor head is capable of rotating around a connection to said mouthpiece stabilizer.

2. The facial exercise apparatus of claim 1, wherein said at least one flexor arm is at least three flexor arms, and wherein said flexor head is capable of receiving said at least three flexor arms radially at ninety-degree intervals along said substantially cylindrical portion of said flexor head.

3. The facial exercise apparatus of claim 1, wherein said flexing component comprises an adjustable spring capable of adjusting a resistance against said at least one lip portion.

4. The facial exercise apparatus of claim 2, wherein said at least three flexor arms is at least four flexor arms.

5. The facial exercise apparatus of claim 1, wherein said mouthpiece stabilizer is molded from an impression of a bite pattern of the patient.

6. The facial exercise apparatus of claim 1, wherein said at least one flexor arm comprises at least one of a group of component parts, selected from the group of component parts consisting of a base connector, an interior compressor rod, a lock, an interior spring, an aperture, a resistance adjustment gauge, a case and a contoured lip holder having a lip holder back rear edge and a lip holder top front edge or combinations thereof.

7. The facial exercise apparatus of claim 1, wherein said flexor head comprises at least one of a group of component parts, selected from the group of component parts consisting of a first connection port, a second connection port, a third connection port, a fourth connection port, an end cap, an end chamber, and a resistance adjustment gauge panel or combinations thereof.

8. The facial exercise apparatus of claim 1, wherein said mouthpiece stabilizer comprises at least one of a group of regions, selected from the group of regions consisting of a teeth canal, a teeth support, a right arm, a left arm, and a mouthpiece front plate and further comprises a mouthpiece connector or combinations thereof.

9. The facial exercise apparatus of claim 6, wherein a resistance measurement may be visible using said resistance adjustment gauge.

10. The facial exercise apparatus of claim 6, wherein a resistance may be adjusted using said resistance adjustment gauge.

11. A method of strengthening facial muscles and reducing an appearance of wrinkles on a face of a patient, the method comprising:

providing a facial exercise apparatus to a patient, said facial exercise apparatus comprising an at least one flexor arm, a flexor head having a substantially cylindrical portion and a front and rear end, and a mouthpiece stabilizer, said at least one flexor arm capable of being connected to said flexor head at an at least one location along said substantially cylindrical portion and said mouthpiece stabilizer capable of being connected to said flexor head at said rear end wherein the flexor head is capable of rotating around a connection to said mouthpiece stabilizer;

securing said facial exercise apparatus within said mouth of said patient by having said patient insert said mouthpiece stabilizer into a mouth of said patient and bite down on said mouthpiece stabilizer;

fitting said at least one flexor arm around an at least one lip portion of said patient; and instructing said patient to perform a set of resistance exercises by moving said at least one lip portion toward said flexor head.

12. The method of claim 11, wherein the at least one flexor arm comprises an upper component contoured to surround an at least one portion of a lip of said patient selected from a group of portions consisting of an upper lip, a lower lip, a left portion, and a right portion or combinations thereof, perpendicularly connected to a flexing component capable of providing at least one level of resistance against said at least one lip portion, the flexor head is capable of receiving said at least one flexor arm, and the mouthpiece stabilizer has a size and shape sufficient to secure said apparatus within a mouth of said patient when said patient bites down upon said mouthpiece stabilizer, said mouthpiece stabilizer capable of connecting to said flexor head.

13. The method of claim 12, wherein said at least one flexor arm is a total of four flexor arms, wherein said flexor head is capable of receiving said total of four flexor arms radially at ninety-degree intervals along said substantially cylindrical portion.

14. The method of claim 12, wherein the flexing component comprises an adjustable spring capable of adjusting a resistance against said at least one lip portion.

15. The method of claim 12, further comprising a step of molding the mouthpiece stabilizer according to an impression of a bite pattern of said patient.

16. The method of claim 12, wherein said at least one flexor arm comprises at least one of a group of component parts, selected from the group of component parts consisting of a base connector, an interior compressor rod, a lock, an interior spring, an aperture, a resistance adjustment gauge, a case and a contoured lip holder having a lip holder back rear edge and a lip holder top front edge or combinations thereof.

17. The method of claim 12, wherein said flexor head comprises at least one of a group of component parts, selected from the group of component parts consisting of a first connection port, a second connection port, a third connection port, a fourth connection port, an end cap, an end chamber, and a resistance adjustment gauge panel or combinations thereof.

18. The method of claim 12, wherein said mouthpiece stabilizer comprises at least one of a group of regions, selected from the group of regions consisting of a teeth canal, a teeth support, a right arm, a left arm, and a mouthpiece front plate and further comprises a mouthpiece connector or combinations thereof.

19. The method of claim 12, wherein the method is used to treat at least one condition selected from a group of conditions consisting of stroke palsy, idiopathic facial paralysis, Bell's palsy, and a cosmetic facial wrinkle or combinations thereof.

* * * * *